US009422148B1

(12) United States Patent
Strickland, Jr.

(10) Patent No.: US 9,422,148 B1
(45) Date of Patent: Aug. 23, 2016

(54) ARTICLE FOR REMOTE OPERATION OF A SPRAY CONTAINER

(71) Applicant: Roderick P. Strickland, Jr., Okatie, SC (US)

(72) Inventor: Roderick P. Strickland, Jr., Okatie, SC (US)

( * ) Notice: Subject to any disclaimer, the term of this patent is extended or adjusted under 35 U.S.C. 154(b) by 0 days.

(21) Appl. No.: 14/524,223

(22) Filed: Oct. 27, 2014

Related U.S. Application Data

(60) Provisional application No. 61/895,559, filed on Oct. 25, 2013.

(51) Int. Cl.

| | |
|---|---|
| ***B65D 83/16*** | (2006.01) |
| ***B67D 7/84*** | (2010.01) |
| *B65D 83/20* | (2006.01) |
| *B05B 15/06* | (2006.01) |
| *E01C 23/22* | (2006.01) |

(52) U.S. Cl.
CPC ..... *B67D 7/84* (2013.01); *B05B 15/064* (2013.01); *B65D 83/203* (2013.01); *B65D 83/208* (2013.01); *E01C 23/227* (2013.01)

(58) Field of Classification Search
CPC .... B67D 7/84; B65D 83/203; B65D 83/208; B05B 15/064; E01C 23/227
See application file for complete search history.

(56) References Cited

U.S. PATENT DOCUMENTS

| | | | | |
|---|---|---|---|---|
| 3,716,195 | A | 2/1973 | Silva | |
| 3,861,566 | A * | 1/1975 | Wentzell | B65D 83/208 222/174 |
| 4,023,711 | A * | 5/1977 | Sena | B05B 15/064 222/174 |
| 4,092,000 | A * | 5/1978 | Offutt, III | B65D 83/203 222/174 |
| 4,262,821 | A * | 4/1981 | Smrt | B65D 83/203 118/305 |
| 4,660,745 | A | 4/1987 | Hess, Jr. | |
| 4,789,084 | A * | 12/1988 | Yoshitomi | B05B 15/064 222/174 |
| 4,886,191 | A | 12/1989 | Yoshitomi | |
| 5,307,959 | A * | 5/1994 | Bedore | B65D 83/203 222/174 |
| 5,518,148 | A * | 5/1996 | Smrt | B05B 12/002 222/174 |
| 6,173,870 | B1 | 1/2001 | Taylor | |
| 6,293,442 | B1 | 9/2001 | Mollayan | |
| 6,390,336 | B1 | 5/2002 | Orozco | |
| 6,868,989 | B2 * | 3/2005 | Fahy | B65D 83/203 222/174 |
| 6,966,461 | B2 | 11/2005 | Warner et al. | |
| 7,004,658 | B2 | 2/2006 | Hall et al. | |
| 7,040,510 | B1 * | 5/2006 | Hester | B05B 11/3056 222/174 |
| 7,048,151 | B1 * | 5/2006 | Wertz | B65D 83/203 222/174 |
| 7,076,916 | B2 * | 7/2006 | Bianchini | A01M 1/2038 222/174 |
| 7,252,210 | B1 * | 8/2007 | Schultz | B65D 83/203 222/174 |
| 7,303,155 | B2 * | 12/2007 | Kesti | B05B 12/00 222/174 |
| D636,266 | S | 4/2011 | Walker et al. | |
| 8,430,272 | B2 * | 4/2013 | Porter | B65D 83/203 222/174 |
| 8,444,020 | B1 | 5/2013 | Kenny | |
| 2004/0094577 | A1 | 5/2004 | Drew | |

* cited by examiner

*Primary Examiner* — Frederick C Nicolas
(74) *Attorney, Agent, or Firm* — P. Jeff Martin; The Law Firm of P. Jeffrey Martin, LLC

(57) ABSTRACT

An article for retaining a spray container having a spray nozzle for discharging contents stored in the spray container. The article includes an elongated spine, a base formed at one end of the spine which supports a spray container, a hand grip formed at an opposite end of the spine, the hand grip is rotationally coupled to the spine, and a mechanical finger positioned along the spine. The article further includes a trigger for remotely controlling the position of the mechanical finger relative to the spray nozzle of the spray container.

10 Claims, 10 Drawing Sheets

ARTICLE FOR REMOTE OPERATION OF A SPRAY CONTAINER

I. RELATED APPLICATIONS

This application claims priority to U.S. Provisional Patent Application No. 61/895,559, filed on Oct. 25, 2013 and entitled, "Article For Remote Operation Of A Spray Container". The entire contents of which are herein incorporated by reference.

II. TECHNICAL FIELD OF THE INVENTION

The present application describes and discloses an article for remote operation of a spray container, and more specifically, describes an article utilizing a distally positioned grip and trigger for remotely controlling the discharge of spray container contents and for optimizing the use of the article to dispense the contents toward the user as desired.

III. BACKGROUND OF THE INVENTION

There have been numerous attempts to provide a device, apparatus, or article to achieve remote discharge of the contents in a spray container. Several devices designed for such use and function are intended to allow a user to discharge the container contents away from the user at variable heights or depths, typically focused on discharging aerosolized paint, epoxy, insulation, or other types of construction-grade material at a height (or depth) or angle not easily negotiated by the user without the use of a ladder, scaffolding or other such devices. Many of these devices include a lever directly connected to the aerosol nozzle and a means for actuating the lever, such as a draw-string or cord, in an attempt to remotely control the discharge and resulting placement of the contents dispensed via the container. Most of the known art is designed and intended for discharge of the contents in a direction away from the user.

A search of the prior art did not disclose any patents that read directly on the claims of the instant invention; however, the following references were considered related:

U.S. Pat. No. 6,966,461 B2, issued in the name of Warner et al.;

U.S. Pat. No. 7,252,210 B1, issued in the name of Schultz et al.;

U.S. Pat. No. 3,716,195, issued in the name of Silva;

U.S. Pat. No. 4,660,745, issued in the name of Hess, Jr.;

U.S. Pat. No. 6,173,870 B1, issued in the name of Taylor;

U.S. Pat. No. 8,444,020 B1, issued in the name of Kenny;

U.S. Pat. No. 4,886,191, issued in the name of Yoshitomi;

U.S. Pat. No. 6,390,336 B1, issued in the name of Orozco;

U.S. Pat. No. D636,266 S, issued in the name of Walker et al.;

U.S. Pat. No. 7,004,658 B2, issued in the name of Hall et al.;

U.S. Patent Application no. 2004/0094577 A1, published in the name of Drew; and

U.S. Patent no. 6, 293, 442 B1, issued in the name of Mollayan.

However, at present, there appears to be a need for an article for remotely operating a spray container to control the discharge and placement of container contents in a manner that places such contents on the user as desired, and more broadly, for accommodating unusual angles or other such challenges.

This application presents claims and embodiments that fulfill a need or needs not yet satisfied by the products, inventions and methods previously or presently available. In particular, the claims and embodiments disclosed herein describe an article for retaining and allowing for the remote operation of a spray container, the article comprising: a spine; a base; a handgrip; a mechanical finger; a depressible actuating trigger formed along the handgrip; means for pivotally-adjusting the grip relative to the spine; a means for vertically adjusting the spine; a retention member; and an extension member, the article of the present invention providing unanticipated and nonobvious combination of features distinguished from the products, devices, apparatuses, inventions and methods preexisting in the art. The applicant is unaware of any product, method, disclosure or reference that discloses the features of the claims and embodiments disclosed herein.

IV. SUMMARY OF THE INVENTION

An article for retaining a spray container is disclosed, wherein the article comprises an elongated spine, a base integrally formed at one end of the spine, and a hand grip formed at an end opposing the base. The base is adapted and configured to support a spray container. In accordance to one exemplary embodiment, the hand grip may be rotationally coupled to the spine.

The article of the present invention further comprises a mechanical finger positioned along the spine, and a depressible actuating trigger formed along the hand grip for remotely controlling the position of the mechanical finger relative to the spray nozzle of the spray container.

V. BRIEF DESCRIPTION OF THE DRAWINGS

VI. DETAILED DESCRIPTION OF THE EMBODIMENT(S)

It will be readily understood that the components of the present invention, as generally described and illustrated in the figures herein, may be arranged and designed in a wide variety of different configurations. Thus, the following detailed description of the embodiments as represented in the attached figures, is not intended to limit the scope of the invention as claimed, but is merely representative of selected embodiments of the invention.

Figure 1:
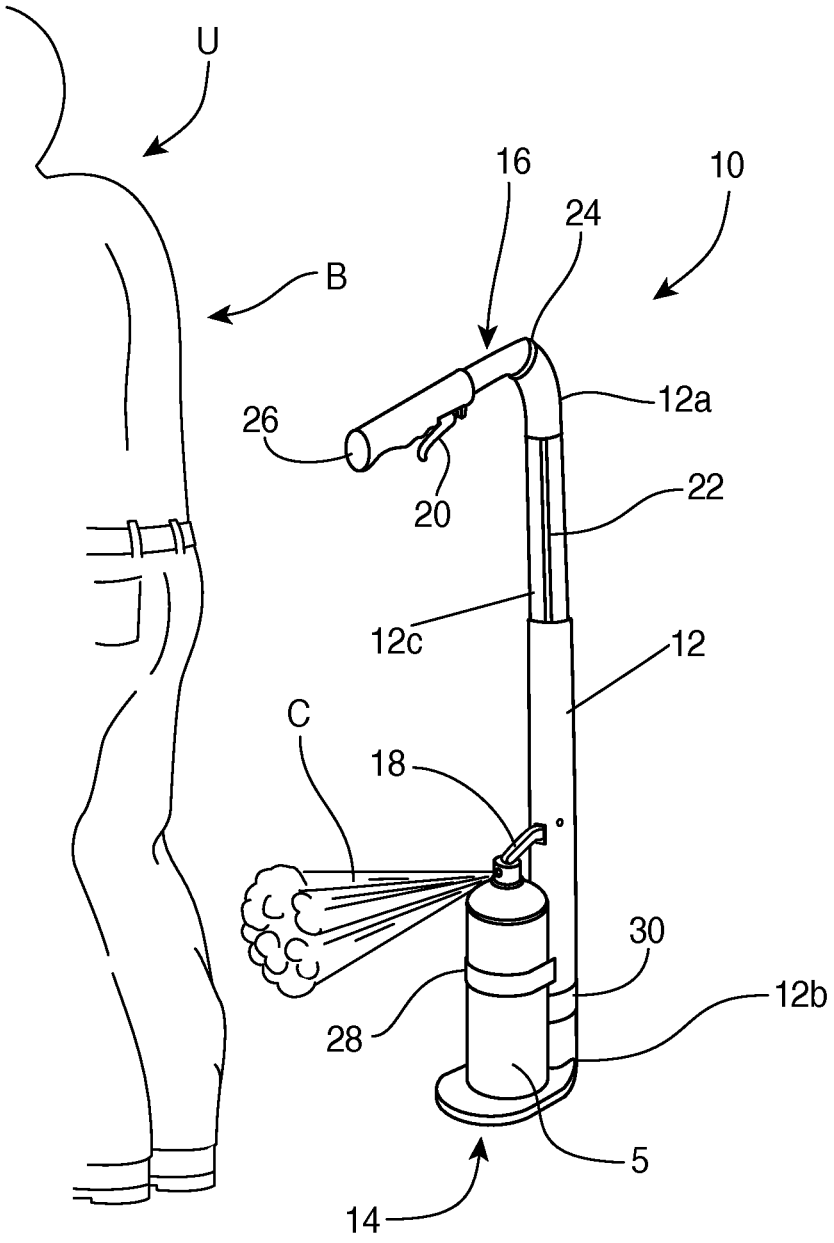
FIG. 1 is a side perspective view of an article for retaining a spray container, in accordance to one embodiment of the present invention.
Figure 1A:
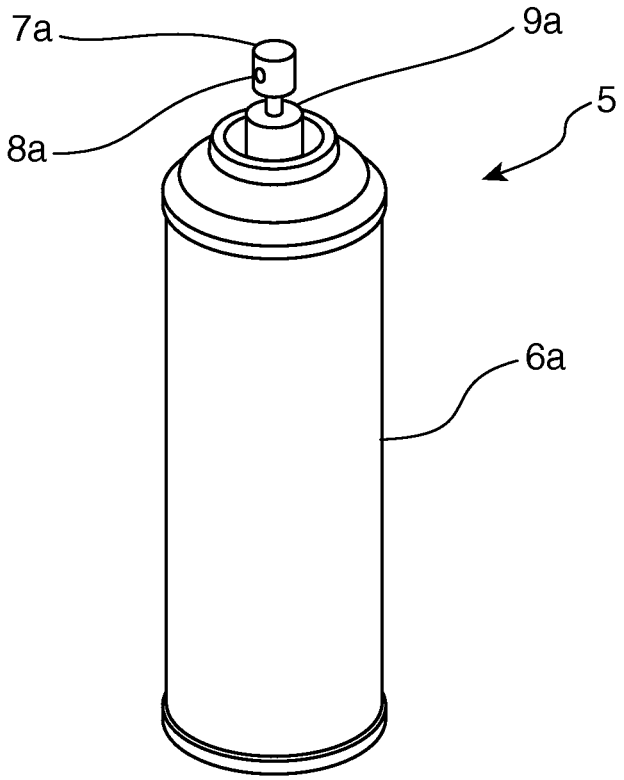
FIG. 1A is a perspective view of an aerosol spray container.
Figure 1B:
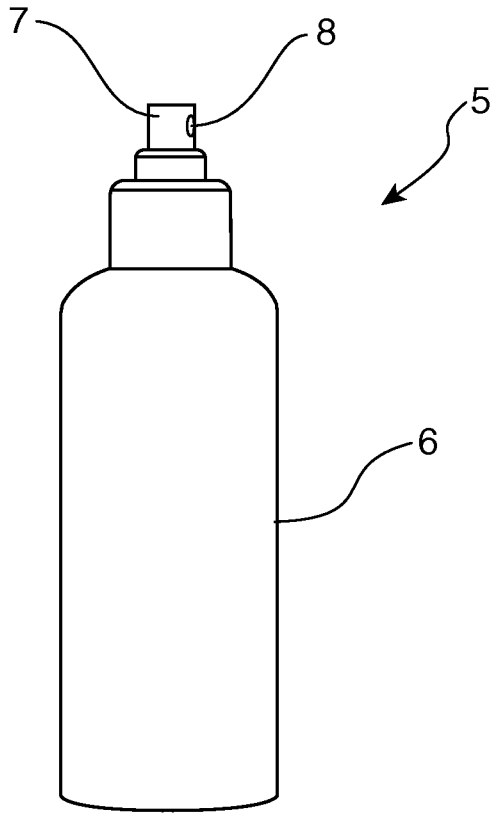
FIG. 1B is a side elevational view of a non-aerosol spray container.

As depicted in FIG. 1, and in accordance with at least one embodiment envisioned herein, an article 10 for retaining a spray container is depicted and described. In reference to FIGS. 1A and 1B, a spray container 5, including non-aerosol containers 6 or dispensers, and pressurized containers 6*a* having aerosol discharging mechanisms, atomizer nozzles, and mister-type nozzles having a spray nozzle mechanism for discharging contents stored in the spray container 5, may be selectively retained and removed by the article 10 for optimized remotely controlled discharge of the container 5 contents, including selectively positional discharge of the contents away from and/or towards the user. An aerosol or aerosol device, as referenced herein, is defined by the Code of Federal Regulations as follows, "Aerosol shall mean a material which is dispensed from its container as a mist, spray, or foam by a propellant under pressure" (Code of Federal Regulation, Title 29, Chapter 17, Part 1910, Section 1910.106). A further specification of the definition is as follows, "Aerosol discharging mechanism means a device or product characterized by a pressurized spray system that dispenses product ingredients in aerosol form by means of a propellant (e.g., a liquefied or compressed gas that is used in whole or in part, such as a co-solvent, to expel a liquid or any other material from the same self-pressurized container or from a separate container) or mechanically induced force. 'Aerosol product' does not include pump sprays." (Code of Federal Regulation, Title 40, Chapter 1, Part 59, Section 59.202).

The pressurized is filled with container 6*a* is filled with a compressed gas or propellant and a composition of material, or contents to be discharged as a spray S or mist therefrom. A depressible button 7 is mounted on the upper end of the pressurized container 6*a*, and the button 7 is provided with a spray nozzle 8. The lower end of button 7 is connected with an ejecting valve which is contained in the pressurized container 6*a* via a stem 9.

In contrast, non-aerosol containers 6 use a positive displacement pump that acts directly on the contents stored in the reservoir of the container 6. Typically, a non-aerosol pump includes an actuator 7 (such as a cap or trigger) connected thereto which activates the pump, such as by pressing or pulling actuator 7, depending on actuator 7 type. The actuator 7 is provided with a spray nozzle 8. The pump is connected to and in fluid communication with a syphon tube that draws container contents from the bottom of the reservoir of container 6. A non-aerosol container 6 also includes one or more one-way valves. A first one-way valve may be connected between the pump and the reservoir, and a second one-way valve may be connected between the pump and the nozzle 8. The first one-way valve may include a cylinder housing a piston being movable in the housing, and a spring positioned between the piston and a collar of the cylinder. A seal may be disposed below the cylinder. When the actuator 7 is released ("upstroke"), the second one-way valve closes, or otherwise presses against the discharge outlet of nozzle 8 which prevents air from flowing in through the nozzle 8. Concurrently upon release of the actuator 7, the spring expands causing downward movement by piston against the seal so that the container contents passageway is blocked off. Engagement by piston against the seal shuts off fluid communication between the reservoir and the pump. When the actuator 7 is pressed or pulled ("downstroke"), the inward pressure from the pump pulls the piston upwardly disengaging the seal, compresses the spring, and shrinks the volume of the cylinder, thereby forcing contents out of the pump which flows therefrom through the nozzle 8 as a spray S. This action (upward movement by piston) causes a decrease in air pressure in the pump system creating suction which draws container contents upward from the reservoir and past the seal.

Figure 2:
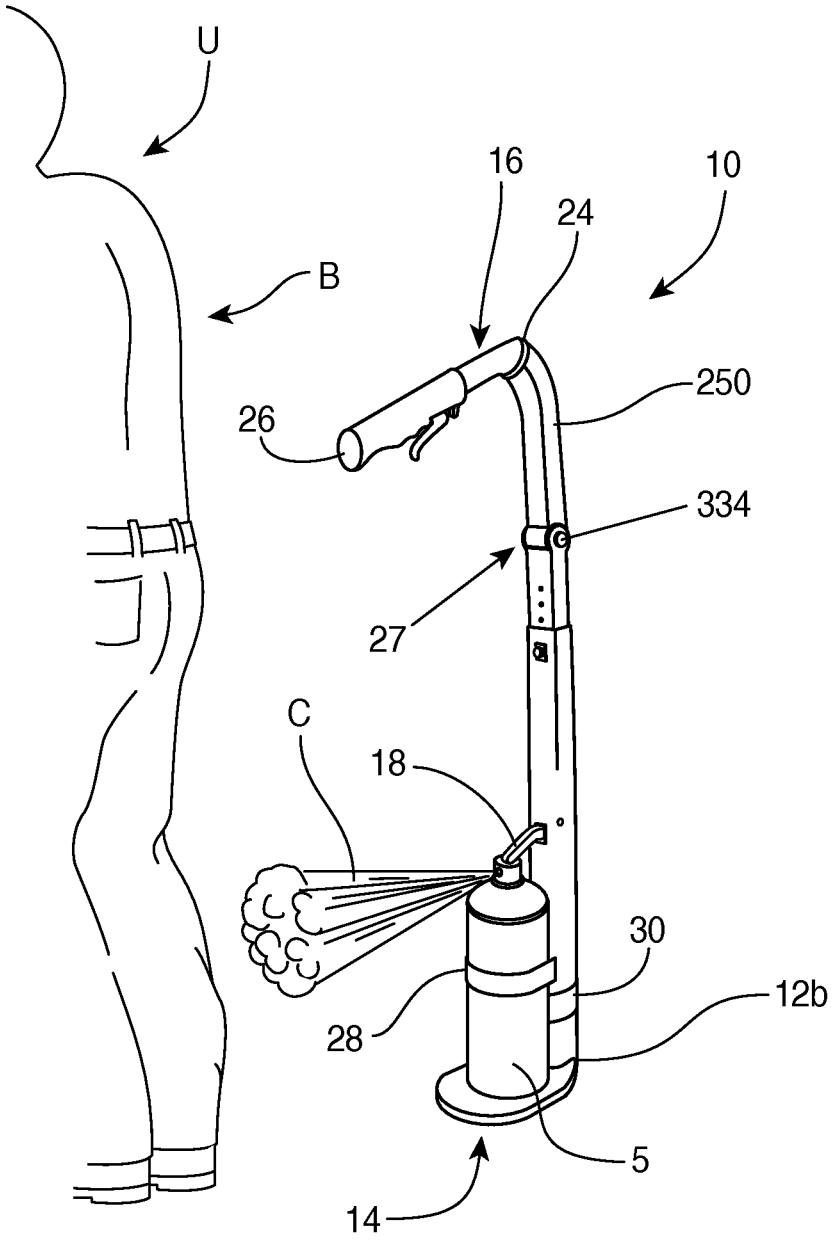
FIG. 2 is a side perspective view of an article for retaining a spray container, in accordance to another embodiment of the present invention.
Figure 3:
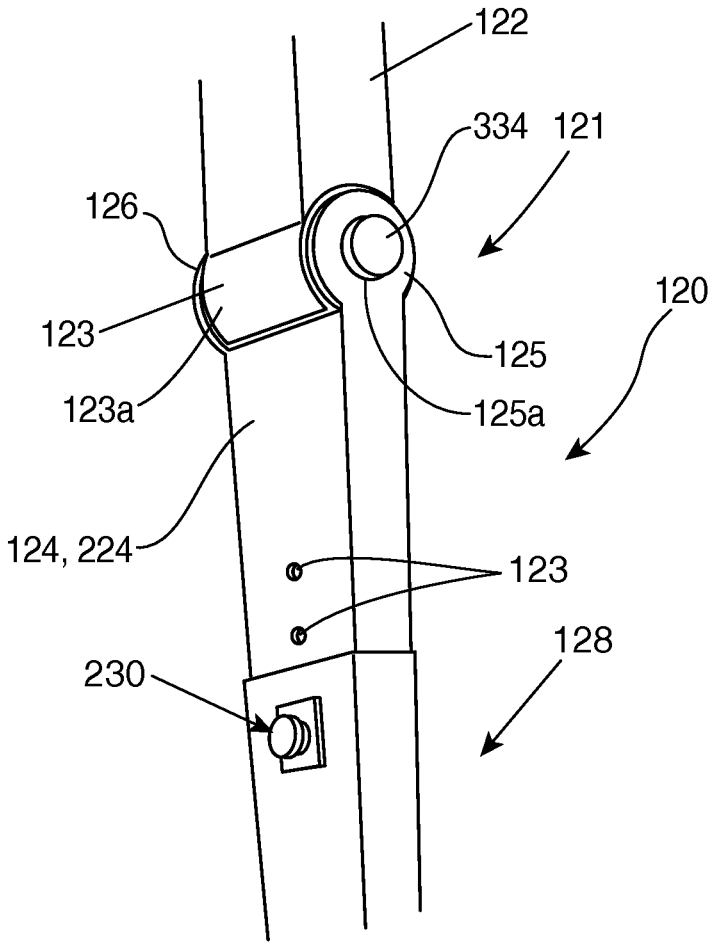
FIG. 3 is a partial left, front perspective view of means for pivotally-adjusting the grip relative to the spine of an article for retaining a spray container, in accordance to one embodiment of the present invention.
Figure 3A:
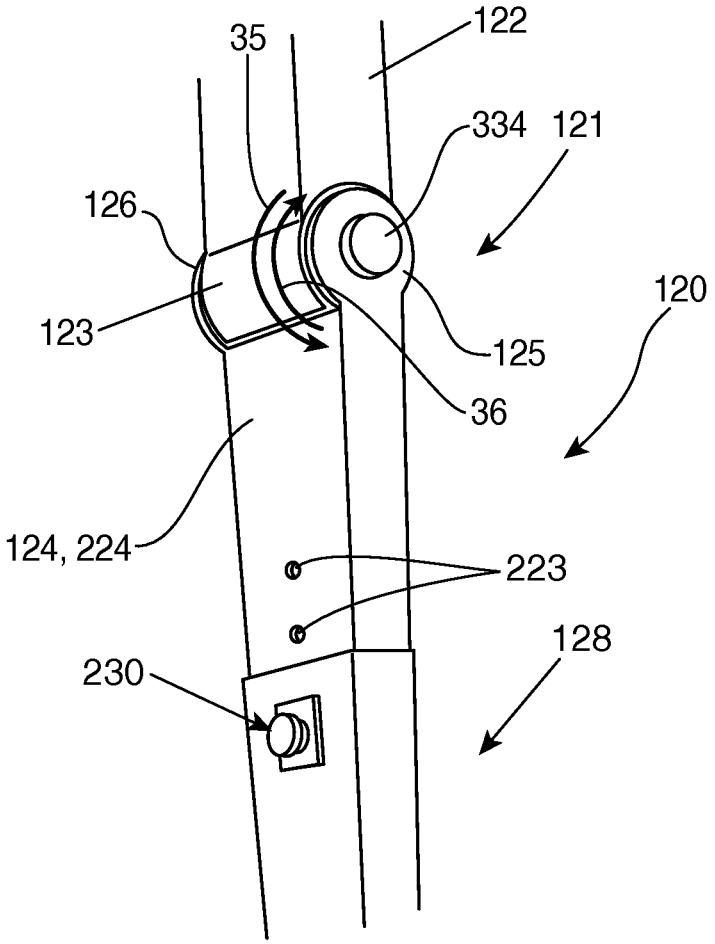
FIG. 3A illustrates the pivot range and direction provided by the pivot means of FIG. 3.
Figure 4:
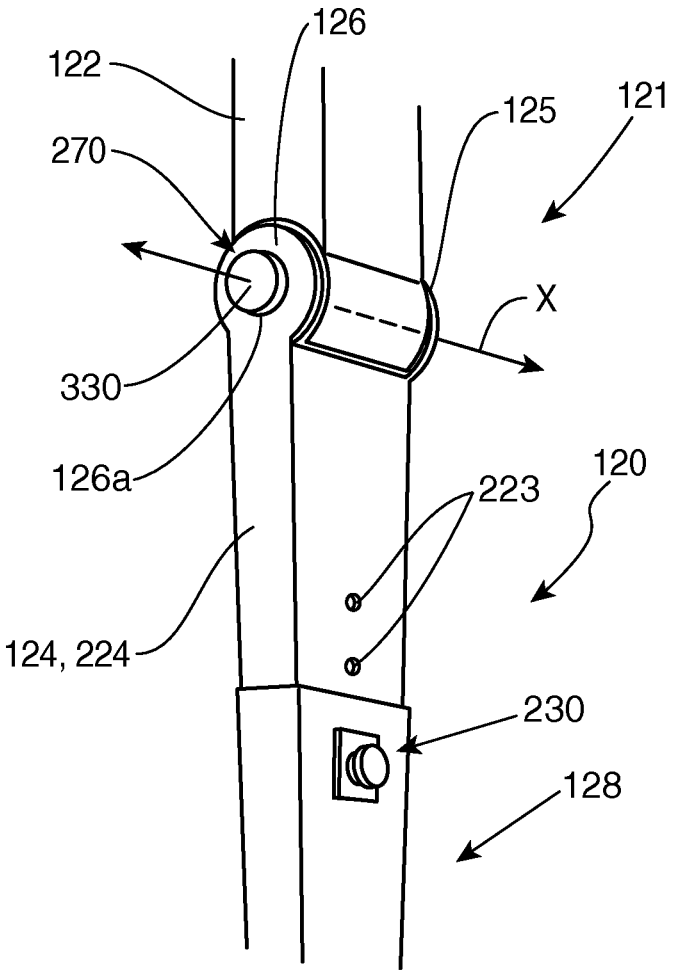
FIG. 4 is a partial right, front perspective view of the pivot means of FIG. 3.
Figure 5:
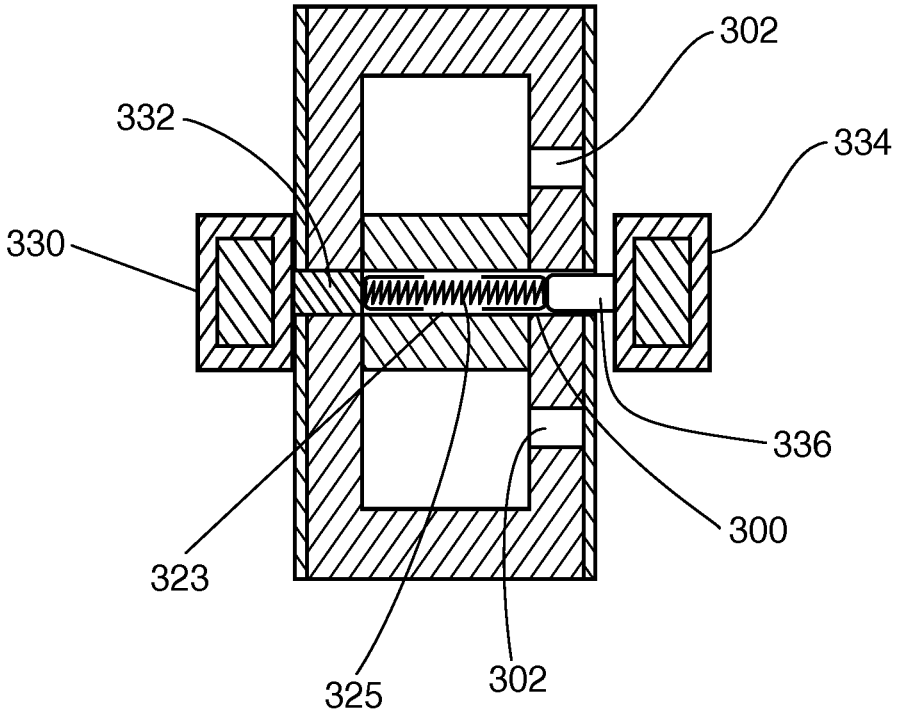
FIG. 5 is a cross-sectional view, on an enlarged scale, of a hinge mechanism wherein the locking pin thereof is shown in a locked condition, in accordance to one embodiment of the present invention.
Figure 6:
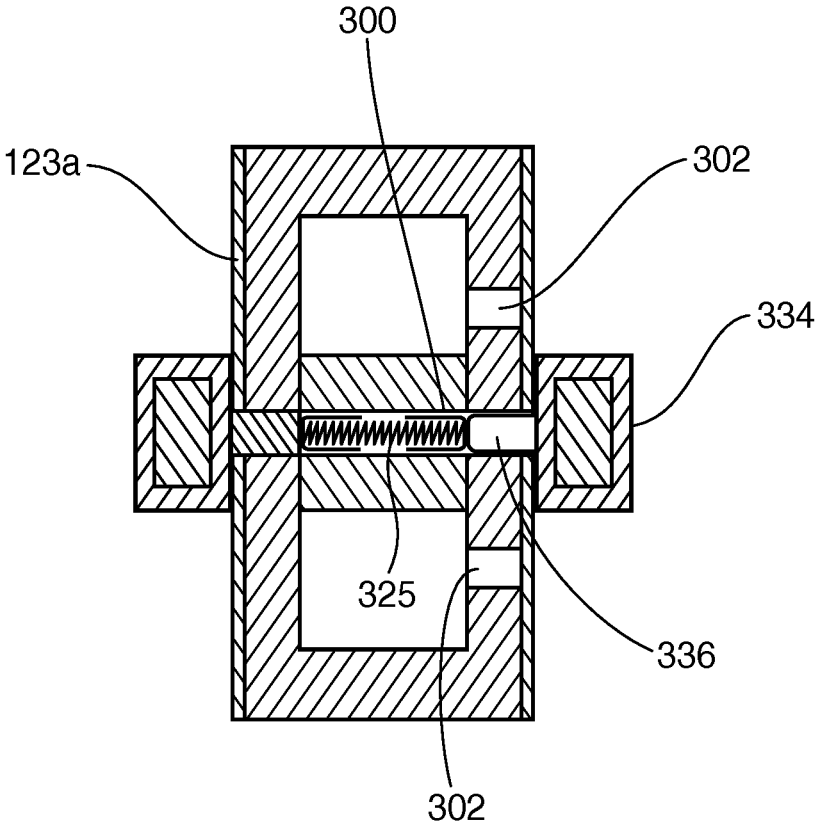
FIG. 6 is a cross-sectional view, on an enlarged scale, of the hinge mechanism of FIG. 5, wherein the locking pin thereof is shown in a released condition.

Referring now more particularly to FIGS. 1-2, the article 10 comprises an elongated, tubular spine 12, a base 14 formed at a lower end 12*b* of the spine 12, and a hand grip 16 formed at an end 12*a* opposing the base 14. Being tubular, the spine 12 includes an interior volume 12*c* of space. The base 14 supports a spray container 5 and may comprise multiple embodiments, including a non-contoured platform, a contoured platform having flexible and/or deformable portions for fiction-fit impingement of the base-end of the container 5, one or more feet with lips for engaging the perimeter of the container 5, a housing with a volume for housing and retaining a portion of the container 5, and other similar configurations known in the art.

Near the base 14, a mechanical finger 18 is positioned along the spine 12. The finger 18 is remotely controlled by a depressible trigger 20 positioned along the grip 16, with a mechanical linkage 22 mechanically coupling the finger 18 and trigger 20, of which the linkage 22 may be hidden from view within the interior volume 12*c* of the spine 12.

The grip 16 is formed at an end opposing the base 14. The grip 16 may be rotationally coupled to the spine 12, allowing a user to adjust the grip 16 for optimized hand-positioning to accommodate unusual or even awkward angles. The rotational coupling may be achieved by a number of means or mechanisms 24 known in the art, including incrementally adjustable ratchet or cogwheel gearing systems or devices similar in type and function. The grip 16 may also include a molded ergonomic contour. The grip 16 may also include a palm brace 26 to allow a user to securely hold the grip 16 to achieve a forward or rearward orientation of the article 10 for further optimization of use.

The actuating trigger 20 remotely controls the mechanical finger 18 via flexible mechanical linkage 22, so that when the trigger 20 is depressed, the linkage 22 mechanically urges the finger 18 into mechanical engagement with the spray nozzle 8 or 8*a* of the container 5 to release or discharge the contents of the container 5 through the nozzle mechanism. Upon release of the trigger 20 (after depressed-actuation), the linkage 22 mechanically releases the finger 18, and the finger 18 disengages the spray nozzle 8 or 8*a* and release or discharge of the contents ceases.

Referring now to FIGS. 2-6, in accordance to one embodiment, a means for pivotally-adjusting the grip 16 relative to the spine 120 along a plurality of selectively-desired, pivotal setting positions is disclosed. In accordance to one embodiment, the means for pivotally-adjusting the grip 16 may comprise a lockable hinge mechanism 27 provided along the length of the spine 12, the lockable hinge 27 providing pivotal adjustability of the grip 16 relative to the base 14

(and supported container 5) as well as pivotal collapsibility of the article 10 for compact storage during non-use. The hinge mechanism 27 may comprise a plurality of known devices in the art for achieving adjustability and/or collapsibility of the article 10. Thus, the hinge mechanism 27 is adapted and configured to allow pivotal articulation of the grip 16 for approximately 180° along the hinge 27 connection. In accordance to one embodiment, the spine 120 comprises an upper section 121 and a lower section 128. The upper section 121 and lower section 128 may comprise a number of cross-sectional configurations, such as, including but not limited to, circular or cylindrical, square, and rectangular. The upper section 121 comprises a first elongated member 122 pivotally secured to a second elongated member 124 via a pivot pin 270 of the hinge mechanism 27. The mechanism 27 allows the first elongated member 122 of upper section 121 of the spine 120, and hence the grip 16, to be pivotally-adjusted about a plurality of selectively-desired, pivotal setting positions. The hinge mechanism 27 allows the first elongated member 122 to pivot (arrows 35 and 36) about pivot axis X (pivot pin 270) over a range of approximately 180°. Pivot pin 270 comprises a number of components operating in a joint collective effort. These components comprise a coupling button 330, a transverse hole 323, a locking pin 300, and a lock release button 334 (all of which to be described later in greater detail).

As the first elongated member 122 pivots, the second elongated member 124 remains stationary. Opposing sides of the second elongated member 124 may include upwardly projecting ears 125 and 126, the ears 125 and 126 flanking the lower sides of the lower end 223 of first elongated member 122, respectively. The ears 125, 126 each include an aperture 125*a*, 126 defined, respectively, therethrough.

The selective pivotal adjustment and setting of the first elongated member 122 relative to the second elongated member 124 may be achieved by a number of means or mechanisms known in the art, including incrementally adjustable spring-biased pin assemblies, cam plate and pin assemblies and systems, ball and socket joint assemblies, mechanical interference and impingement devices, or devices similar in type and function commonly known in the art.

In further reference to FIGS. 2-6, in accordance to one exemplary embodiment, the hinge mechanism 27 is housed within the lower end 223 of the first elongated member 122 and thus concealed from view. The lower end 123 of first elongated member 122 may comprise a generally cylindrical or barrel-shaped portion 123*a* which houses the hinge mechanism 27. The cylindrical portion 123*a* of first elongated member 122 is similar to the chamber of a revolver type firearm, wherein such revolver has a cylinder which includes a series of chambers bored therethrough. A transverse hole 323 extends through the cylindrical portion 123*a*. A locking pin 300 is disposed inside the transverse hole 323, the locking pin 300 cooperates with a series of pin-receiving holes 302 to lock the first elongated member 122 in selectively-desired pivotal positions relative to the second elongated member 224. The pin-receiving holes 302 are spatially aligned in a semi-circular orientation, the orientation consistent to or uniform with the transverse hole 323. The pin-receiving holes 302 are defined in the cylindrical portion 123*a* and are coaxially aligned with pivot axis X. A compression spring 325 is positioned between the hub 332 of a coupling button 330 and the locking pin 300 to bias the pin 300 outwardly (see FIG. 5) in a resting position of pin 300. The lower end of compression spring 325 is secured to the hub 332, and the upper end of compression spring 325 is received by and firmly engaged with the locking pin 300. The coupling button 330 is mounted to one end of the transverse hole 323, the coupling button 330 opposes a lock release button 334 (to be described in greater detail hereinbelow) disposed along the opposing end of the transverse hole 323. The pin-receiving holes 302 are envisioned to be positioned radially to the lock release button 334, the lock release button 334 is envisioned to be disposed centrally relative to the end of the cylindrical portion 123*a*.

The lock release button 334 is provided to release the pin 300 from a locked condition (FIG. 5) to a released condition (shown in FIG. 6) for the purpose of pivotally adjusting the first elongated member 122. The lock release button 334 includes a release post 336 mounted perpendicularly thereto or integrally extending perpendicularly therefrom. The distal end of release post 336 is engaged against the locking pin 300. The lock release button 334 may be provided with an annular apron for engaging a lip or inner surface of the ear 125 of the second elongated member 224, thereby preventing disengagement of the lock release button 334 from transverse hole 323 and past the ear 125 of the second elongated member 224.

To pivotally adjust the first elongated member 122 relative to the second elongated member 224 at a desired pivotal setting, user presses the lock release button 334 which releases the locking pin 300 and allows pivotal rotation by the first elongated member 122 about pivot axis X relative to the second elongated member 224. Once user selects a desired pivotal position of first member 122, user releases the lock release button 334 and compression spring 325 urges the locking pin 300 outwardly engaging one hole 302 of the series of pin-receiving holes 302, and thus locking the first elongated member 122 in a selectively-desired pivotal position relative to the second elongated member 224.

In reference to FIG. 2, a shroud 250 is disposed along the spine 120. The shroud 250 provides a cover for the mechanical linkage 22, thereby shielding or otherwise concealing the mechanical linkage 22 from view. The shroud 250 may be constructed of a flexible or rigid material, such as a plastic polymer or textile.

Referring now to FIGS. 2-4, and 7-9, a means for adjusting the spine 120, and hence the grip 16, along a plurality of selectively-desired, vertical setting positions is disclosed. In accordance to one embodiment, the means for vertically-adjusting the spine 120 may comprise a telescopic adjustment assembly 200, the assembly 200 comprises an elongated first cylinder 222 telescopically received by a linearly elongated second cylinder 224. The second cylinder 224 includes a cylinder receiving cavity 227 for intimate slidable engagement by the first cylinder 222.

The first cylinder 222 is adjustably lockable to second cylinder 224 at a desired longitudinal position or setting via a locking device 230. In accordance to one embodiment, the locking device 230 is disclosed as a spring-biased pin assembly 232 disposed about the second cylinder 224. The second cylinder 224 includes a hole 225 defined axially through both sides thereof, and the first cylinder 222 includes a series of holes 223 defined through both sides thereof in corresponding relation so that a pin 234 of pin assembly 232 may be utilized to secure the second cylinder 224 and first cylinder 222 at a desired longitudinal position. More specifically, the pin 234 extends through hole 225 of second cylinder 224 and engages a selected hole 223 defined through both sides of first cylinder 222 and exits hole 225 of opposing side of second cylinder 224. Thus, the holes 223 of first cylinder 222 cooperate with the pin 234 of pin assembly 232 that permits the pin 234 to extend initially through the hole 225 of second cylinder 224, through a selected hole 223 of first cylinder 222, and through hole 225 of opposing side of second cylinder 224, thereby securing the inner and outer cylinders 222 and 224 to one another.

In a resting position, pin 234 is urged by a spring (not shown) inwardly towards the cylinder receiving cavity 227 of second cylinder 224. In order to adjustably secure the first and second cylinders 222 and 224 of handle 120 to a selectively-desired longitudinal setting, the pin 234 is retracted or pulled axially until pin 234 is effectively removed from the first cylinder 222, and pin 234 is held in such retracted position, while the inner and outer cylinders 222 and 224 are telescopically adjusted relative to one another to a desired handle 120 length. Upon obtaining desired handle 120 length or longitudinal setting, operator releases pin 234 to allow pin 234 to engage one of the holes 223 of first cylinder 222.

Figure 7:
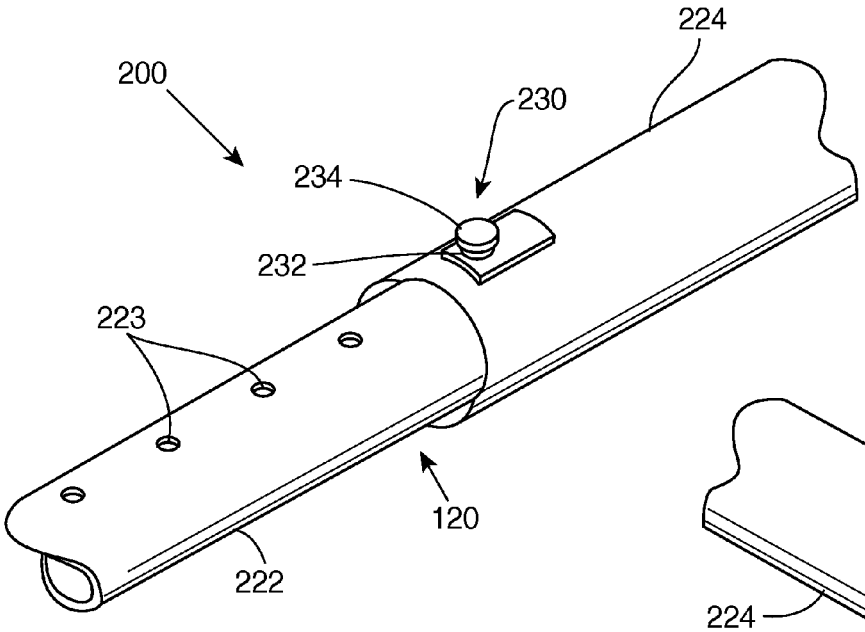
FIG. 7 is a partial perspective view of a means for vertically adjusting the spine, in accordance to one embodiment of the present invention.
Figure 8:
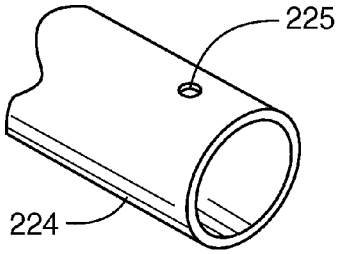
FIG. 8 is a partial perspective view of the second elongated member of the adjustment means of FIG. 7 illustrating the hole defined axially through both sides of the second member.
Figure 9:
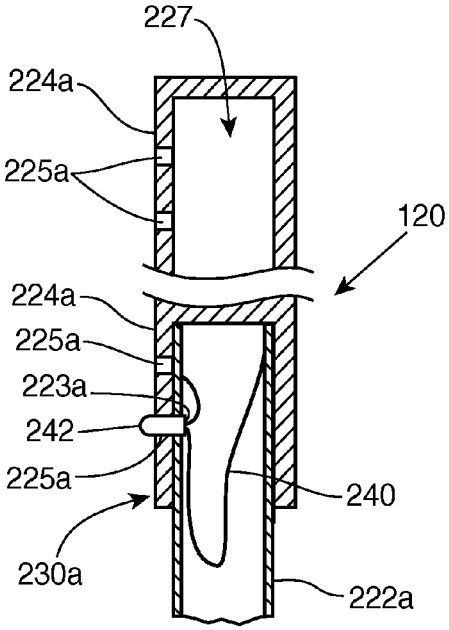
FIG. 9 is a partial, longitudinal sectional view of a means for vertically adjusting the spine, in accordance to another embodiment of the present invention.

In reference to FIG. 7, in accordance to another locking device 230*a* embodiment, locking device 230*a* comprises a generally conical-shaped spring member 240 mounted to an inner surface of first cylinder 222*a*, the spring member 240 includes a button 242 protruding integrally outward therefrom and through an aperture 223*a* defined axially through a sidewall of first cylinder 222*a*. In further accordance to this particular embodiment, the second cylinder 224*a* includes a series of apertures 225*a* defined through at least one sidewall thereof in corresponding relation so as to allow the button 242 to extend through aperture 223*a* of first cylinder 222*a* and to engage and exit a selected aperture 225*a* of second cylinder 224*a*, thereby removably securing the second cylinder 224*a* and first cylinder 222*a* at a desired longitudinal position. A distal segment of spring member 240 extends and engages the inner surface of first cylinder 222*a* to bias the button 242 into a selected aperture 225*a* of second cylinder 224*a*.

Vertical adjustability of the spine 120 may be achieved by any of the several known methods for providing telescopic adjustment, including interference impingement coordinated and indexed between the spine 120 and the elongated telescoping elements comprising the spine 120.

Referring now more particularly to FIGS. 1-2, the spine 12, 120 may also include a retention member 28 for operation separate from or in conjunction with the base 14. The retention member 28 may be integrally extending from, coupled to, or removably securable to the spine 12, proximal to the base 14. The retention member 28 may comprise any number of devices known in the art, including returnably-resilient clamp members for articulation to accommodate small diameter and large diameter commercially available containers 5. In one embodiment envisioned, the clamp members comprise at least two separate clamp members secured along the spine 12, 120, each clamp member forming approximately one-half of the perimeter of a container 5, with each clamp member working in conjunction to encompass at least half of the perimeter of the container 5. Other retention members 28 are also envisioned, including an adjustable band or other similar mechanisms.

The spine 12, 120 may also include an extension member 30 for horizontal and/or vertical adjustable positioning of the base 14 relative to the mechanical finger 18. In accordance to one embodiment, to facilitate horizontal adjustment and positioning of the base 14, the base 14 may include an adjustable guide support comprising a raised lip portion with a pair of downwardly extending tongues for slidably engaging a pair of parallel, elongated grooves, respectively, formed in the upper surface of the base 14. The elongated grooves each include a series of raised teeth, wherein the teeth include notches provided therebetween. In order to adjust the guide support to a desired horizontal fixed setting, the downwardly extending tongues of the lip portion are slidably directed along the grooves and engage the notches in a mating fashion.

In another embodiment, to facilitate vertical positioning and adjustment of the base 14, it is envisioned the extension member 30 comprises a spine extension member or portion inserted between the spine 12, 120 and the base 14. Such spine extension members may comprise a number of variably sized portions to accommodate variously sized containers 5, and may also comprise separately telescoping portions to increase the variable adjustment provided. In another embodiment, the extension member 30 may comprise an integrally provided telescoping arrangement to adjust for the smallest container 5 height to the largest container 5 height commercially available. Adjustability may be achieved by any of the several known methods for providing telescopic adjustment, including interference impingement coordinated and indexed between the spine 12, 120 and the elongated telescoping elements provided within the spine 12, 120.

In use, as depicted in FIGS. 1 and 2, a user (U) may utilize the article 10 to dispense the contents of a spray container 5 onto the user's back (B) by allowing the user to place the container 5 on the base 14 and in mechanical communication with the finger 18 and actuating release of the contents via the trigger 20. The orientation of the handle grip 16 and trigger 20 allow the user to position the article 10 and container 5 in a plurality of positions to optimize discharge and placement of the contents. In one example of the envisioned use of the article 10, a user may be able to dispense a sunscreen or tanning products (including sun-tanning and self-tanning products) onto the user's back, which often requires either the application by another person or the understanding that the person will likely not be able to evenly and/or completely cover the user's back-region, obviously risking uneven coverage in certain areas.

It is to be understood that the embodiments and claims are not limited in application to the details of construction and arrangement of the components set forth in the description and/or illustrated in drawings. Rather, the description and/or the drawings provide examples of the embodiments envisioned, but the claims are not limited to any particular embodiment or a preferred embodiment disclosed and/or identified in the specification. Any drawing figures that may be provided are for illustrative purposes only, and merely provide practical examples of the invention disclosed herein. Therefore, any drawing figures provided should not be viewed as restricting the scope of the claims to what is depicted.

The embodiments and claims disclosed herein are further capable of other embodiments and of being practiced and carried out in various ways, including various combinations and sub-combinations of the features described above but that may not have been explicitly disclosed in specific combinations and sub-combinations.

Accordingly, those skilled in the art will appreciate that the conception upon which the embodiments and claims are based may be readily utilized as a basis for the design of other structures, methods, and systems. In addition, it is to be understood that the phraseology and terminology employed herein are for the purposes of description and should not be regarded as limiting the claims.

What is claimed is:

1. An article for retaining a spray container, the spray container having a spray nozzle for discharging contents stored in the spray container, the article comprising:

an elongated spine;

a base formed at one end of the spine, the base supporting a spray container;

a retention member for retaining the spray container in a fixed position;

a hand grip formed at an end of the elongated spine opposing the base, the hand grip is rotationally coupled to the spine;

a mechanical finger positioned along the spine;

a depressible actuating trigger formed along the hand grip for remotely controlling the position of the mechanical finger relative to the spray nozzle of the spray container;

a mechanical linkage, the mechanical linkage mechanically couples the trigger to the finger; and a lockable hinge mechanism provided along a length of the spine, the lockable hinge mechanism permitting pivotal adjustability of the hand grip relative to the base.

2. The article of claim 1, wherein the grip pivotally articulates about the lockable hinge mechanism approximately 180° relative to the spine.

3. The article of claim 2, wherein the spine includes an upper section and a lower section, the upper section comprises a first elongated member pivotally secured to a second elongated member via the lockable hinge mechanism, the first elongated member pivots about a pivot axis.

4. The article of claim 3, wherein the first elongated member is adjustable about a plurality of selectively-desired, pivotal setting positions.

5. The article of claim 4, wherein the hand grip is rotationally coupled to an upper end of the first elongated member of the upper section of the spine, the grip pivots about the pivot axis and is adjustable about a plurality of selectively-desired, pivotal setting positions.

6. The article of claim 3, further comprising:

a means for vertically-adjusting the spine along a plurality of selectively-desired, vertical setting positions.

7. The article of claim 6, wherein the means for vertically-adjusting the spine along a plurality of selectively-desired, vertical setting positions comprises a telescopic adjustment assembly, the telescopic adjustment assembly comprises:

a locking device;

the first elongated member; and the second elongated member, the first elongated member is telescopically received by the second elongated member, and wherein the first elongated member is lockable to the second cylinder at a desired vertical position via the locking device.

8. The article of claim 7, wherein the locking device comprises a spring-biased pin assembly.

9. The article of claim 1 further comprising a shroud disposed along the spine, the shroud concealing the mechanical linkage from view.

10. An article for retaining a spray container, the spray container having a spray nozzle for discharging contents stored in the spray container, the article comprising:

an elongated spine;

a base formed at one end of the spine, the base supporting a spray container;

a retention member for retaining the spray container in a fixed position;

a hand grip formed at an end of the elongated spine opposing the base, the hand grip is rotationally coupled to the spine;

a lockable hinge mechanism provided along a length of the spine, the lockable hinge mechanism permitting pivotal adjustability of the hand grip relative to the base;

a mechanical finger positioned along the spine;

a depressible actuating trigger formed along the hand grip for remotely controlling the position of the mechanical finger relative to the spray nozzle of the spray container;

a mechanical linkage, the mechanical linkage mechanically couples the trigger to the finger; and an extension member formed along the spine for adjusting the base relative to the mechanical finger in at least one of a horizontal position and a vertical position.

* * * * *